US007152558B2

(12) United States Patent
Chung et al.

(10) Patent No.: US 7,152,558 B2
(45) Date of Patent: Dec. 26, 2006

(54) ELECTROMECHANICAL VALVE ACTUATOR ASSEMBLY

(75) Inventors: Ha T. Chung, Canton, MI (US); Mark L. Hopper, Ypsilanti, MI (US); John D. Norton, Ann Arbor, MI (US); Shawn H. Swales, Canton, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 0 days.

(21) Appl. No.: 11/029,305

(22) Filed: Jan. 5, 2005

(65) Prior Publication Data

US 2005/0115525 A1 Jun. 2, 2005

Related U.S. Application Data

(63) Continuation-in-part of application No. 10/963,892, filed on Oct. 13, 2004.

(60) Provisional application No. 60/510,988, filed on Oct. 14, 2003.

(51) Int. Cl.
*F01L 9/04* (2006.01)

(52) U.S. Cl. ..... 123/90.11; 123/90.24; 251/129.01; 251/129.15

(58) Field of Classification Search ..... 123/90.11, 123/90.24; 251/129.01, 129.15, 129.16
See application file for complete search history.

(56) References Cited

U.S. PATENT DOCUMENTS

| | | | | |
|---|---|---|---|---|
| 4,269,388 | A | 5/1981 | Seilly et al. | |
| 4,762,095 | A | 8/1988 | Mezger et al. | |
| 5,161,494 | A | 11/1992 | Brown, Jr. | |
| 5,772,179 | A | 6/1998 | Morinigo et al. | |
| 6,085,704 | A | 7/2000 | Hara | |
| 6,164,253 | A | 12/2000 | Alberter et al. | |
| 6,262,498 | B1 | 7/2001 | Leiber | |
| 6,382,146 | B1 * | 5/2002 | Lamp | 123/81 B |
| 6,418,892 | B1 | 7/2002 | Donce et al. | |
| 6,427,649 | B1 | 8/2002 | Cristiani et al. | |
| 6,427,650 | B1 | 8/2002 | Cristiani et al. | |
| 6,457,444 | B1 | 10/2002 | LaDow | |
| 6,467,441 | B1 | 10/2002 | Cristiani et al. | |
| 6,516,758 | B1 | 2/2003 | Leiber | |
| 6,526,928 | B1 | 3/2003 | Bauer et al. | |
| 6,546,904 | B1 | 4/2003 | Marchioni et al. | |
| 6,561,144 | B1 | 5/2003 | Muraji | |
| 6,637,385 | B1 | 10/2003 | Muraji | |
| 6,810,840 | B1 * | 11/2004 | von Gaisberg-Helfenberg | 123/90.11 |
| 2002/0057154 | A1 | 5/2002 | Keck | |
| 2003/0177989 | A1 | 9/2003 | Baker | |
| 2004/0108482 | A1 | 6/2004 | Sakuragi et al. | |

FOREIGN PATENT DOCUMENTS

WO WO 99/06677 2/1999

OTHER PUBLICATIONS

"Camless Technology" Engine Technology International, Feb. 2001 (1 page).

* cited by examiner

*Primary Examiner*—Thomas Denion
*Assistant Examiner*—Zelalem Eshete
(74) *Attorney, Agent, or Firm*—Dickinson Wright PLLC

(57) ABSTRACT

A lever electromechanical valve actuator assembly and arrangement of electromechanical valve actuators that creates a compact actuator assembly to increase ease of serviceability, provide space for engine components and eliminate interference between the actuators and components in the vehicle engine compartment.

24 Claims, 14 Drawing Sheets

ELECTROMECHANICAL VALVE ACTUATOR ASSEMBLY

CROSS-REFERENCE TO RELATED APPLICATION

This application is a continuation-in-part of U.S. patent application Ser. No. 10/963,892, filed Oct. 13, 2004 which claims the benefit of U.S. Provisional Application No. 60/510,988, filed Oct. 14, 2003, the entire disclosure of each application is considered part of the disclosure of this application and is hereby incorporated by reference.

BACKGROUND OF THE INVENTION

The present invention relates to electromechanical valves actuators and, more particularly, to compact electromechanical valve actuator assemblies and the arrangement of electromechanical valve actuators on an engine.

As engine technology advances and manufacturers strive to increase engine power, improve fuel economy, decrease emissions, and provide more control over engines, manufacturers are developing electromechanical valve actuators (also known as electromagnetic valve actuators or EMVA) to replace cam shafts for opening and closing engine valves. Electromechanical valve actuators allow selective opening and closing of the valves in response to various engine conditions.

Electromechanical valve actuators generally include two electromagnets and a spring loaded armature plate disposed between the electromagnets. The armature plate is movable between the electromagnets as the power coils are selectively energized to create a magnetic force to attract the armature plate to the energized electromagnet. The surface of the electromagnets to which the armature is attracted is generally referred to as a pole face, and the armature is operationally coupled to the valve so that as the armature moves between pole faces in a pole-face-to-pole-face operation, the valve is opened and closed.

Electromechanical valve actuators are generally formed as linear electromechanical valve actuators or lever electromechanical valve actuators. One problem with linear electromechanical valve actuators is that each linear electromechanical valve actuator operationally coupled to the associated valve includes a relatively large set of electromagnets for opening and closing the valves (FIG. 1). The size of the electromagnets makes it difficult to position all of the linear electromechanical valve actuators over a particular cylinder, especially for engines that have four or more valves per cylinder. The size of linear electromechanical valve actuators may also limit the ease of serviceability of the engine, such as restricting the space available for changing the spark plug. Another problem with linear electromechanical valve actuators is that linear electromechanical valve actuators generally have a substantial height extending from the cylinder head of an engine. The height of the linear electromechanical valve actuators creates difficulty in packaging the linear actuators on engines in today's compact engines and in today's full engine compartments. For example, linear electromechanical valve actuators may interfere with other engine parts, other components or accessories located in the engine compartment, and even the vehicle body, such as, the hood. Yet another problem with linear electromechanical valve actuators is that they generally draw a substantial amount of power from the vehicle's electrical system, as compared with lever electromechanical valve actuators, thereby putting additional demand on the alternator in today's power hungry vehicles.

In view of the drawbacks associated with linear electromechanical valve actuators, many manufacturers have recently turned to lever electromechanical valve actuators, which, due to their mechanical and magnetic properties, generally have substantial power savings over linear electromechanical valve actuators. Lever electromechanical valve actuators also generally do not protrude as far from the cylinder head as linear electromechanical valve actuators. However, a major problem with lever electromechanical valve actuators is still the package size required on the cylinder head. Due to the set locations of valves and spark plugs by engine designers, designs for lever electromechanical valve actuator assemblies on the engine have been traditionally limited. Most lever electromechanical valve actuators packaged on the cylinder head are arranged longitudinally in line with the elongated longitudinal cylindrical head extent of the cylinder head, as shown in FIG. 2. Therefore, each actuator group within the actuator assembly, and associated with a particular cylinder, is arranged laterally across the cylinder head with each individual actuator being arranged longitudinally with the cylinder head. More specifically, the pivot axes of each actuator aligned with the cylinder head longitudinal extent. As shown in FIG. 2, the lever electromechanical valve actuators on an engine having four valves 20 per cylinder 16 require significantly more space across a cylinder head than camshafts, thereby presenting packaging concerns in engine compartments where space is limited. Also, the arrangement of lever electromechanical valve actuators shown in FIG. 2 raises additional serviceability concerns, especially for the ease of servicing and replacing the spark plugs and in some arrangements, the space available for fuel injectors. The difficulty in changing the spark plug as well as servicing the actuators is compounded in that at least two of the actuators are completely within the perimeter of the cylinder walls extended toward the actuators. Therefore, there is a need for additional electromechanical valve actuator arrangements that minimize package space, provide ease of serviceability, and provide room for wiring assemblies and control modules communicating with the individual actuators.

SUMMARY OF THE INVENTION

The present invention relates to electromechanical valve actuators and, more particularly, to compact electromechanical valve actuator assemblies and the arrangement of electromechanical valve actuators on an engine.

Careful arrangement of electromechanical valve actuators to create a compact assembly increases ease of serviceability, provides space for access to various engine components such as the spark plug, provides additional package space for wiring harnesses and control modules of electromechanical valve actuators, and eliminates potential interference between the actuators and components in the vehicle engine compartment or the vehicle body.

The present invention is directed to a lever electromechanical valve actuator assembly for a vehicle engine having cylinders and a cylinder head with a longitudinal cylinder extent, the cylinder head being disposed between the lever electromechanical valve actuator assembly and the cylinders. The electromechanical valve actuator assembly includes a first actuator having a first pivot axis, and a second actuator having a second pivot axis. The first and second pivot axes are each approximately within forty five degrees of perpendicular to the longitudinal cylinder extent.

In another embodiment, the present invention is directed to a lever electromechanical valve actuator assembly for a vehicle engine having cylinders and a cylinder head defining spark plug holes and having a longitudinal cylinder head extent, the cylinder head being disposed between the lever electromechanical valve actuator assembly and the cylinders. The electromechanical valve actuator assembly includes a first actuator having a first pivot axis approximately aligned between two adjacent spark plug holes and approximately aligned with the longitudinal cylinder head extent.

In yet another embodiment, the present invention is directed to a lever electromechanical valve actuator assembly for a vehicle engine having cylinders and a cylinder head with a longitudinal cylinder head extent, the cylinder head being disposed between the cylinders and the electromechanical valve actuator assembly. The electromechanical valve actuator assembly includes a first actuator having a first core and a first power coil, and a second actuator having a second core and a second power coil. Each of the power coils form an end turn on at least one end of each of the first and second cores. The end turns extend a distance beyond the at least one end of each of the first and said second cores and wherein the first core and the second core are arranged so that the first core and the second core are displaced less than two times said distance apart.

Further scope of applicability of the present invention will become apparent from the following detailed description, claims, and drawings. However, it should be understood that the detailed description and specific examples, while indicating preferred embodiments of the invention, are given by way of illustration only, since various changes and modifications within the spirit and scope of the invention will become apparent to those skilled in the art.

BRIEF DESCRIPTION OF THE DRAWINGS

The present invention will become more fully understood from the detailed description given here below, the appended claims, and the accompanying drawings in which:

DETAILED DESCRIPTION OF THE PREFERRED EMBODIMENT

Figure 1:
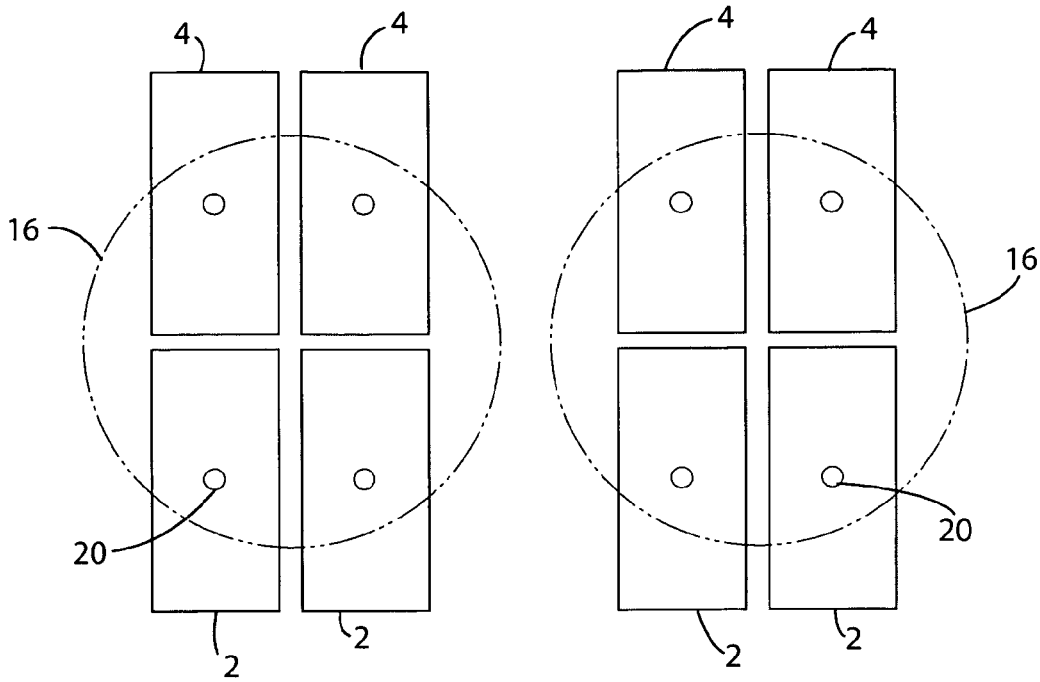
Fig. 1 (Prior Art)
FIG. 1 is a prior art top plan view of the placement of linear electromechanical valve actuators over cylinders.
Figure 2:
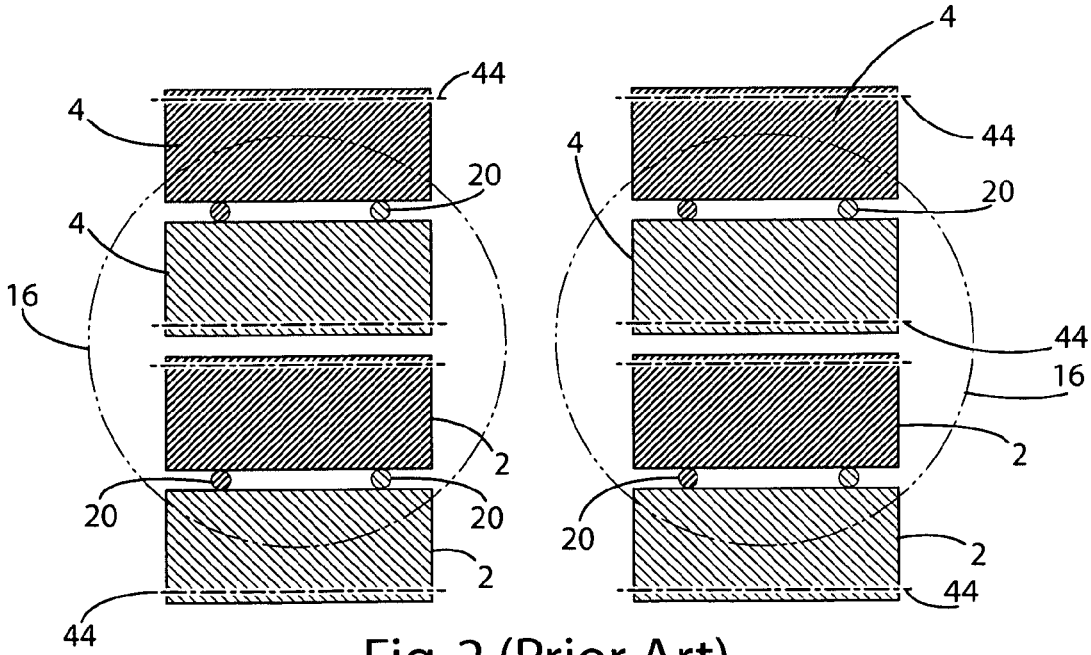
Fig. 2 (Prior Art)
FIG. 2 is a prior art top plan view of the lever electromechanical valve actuators over cylinders.
Figure 3:
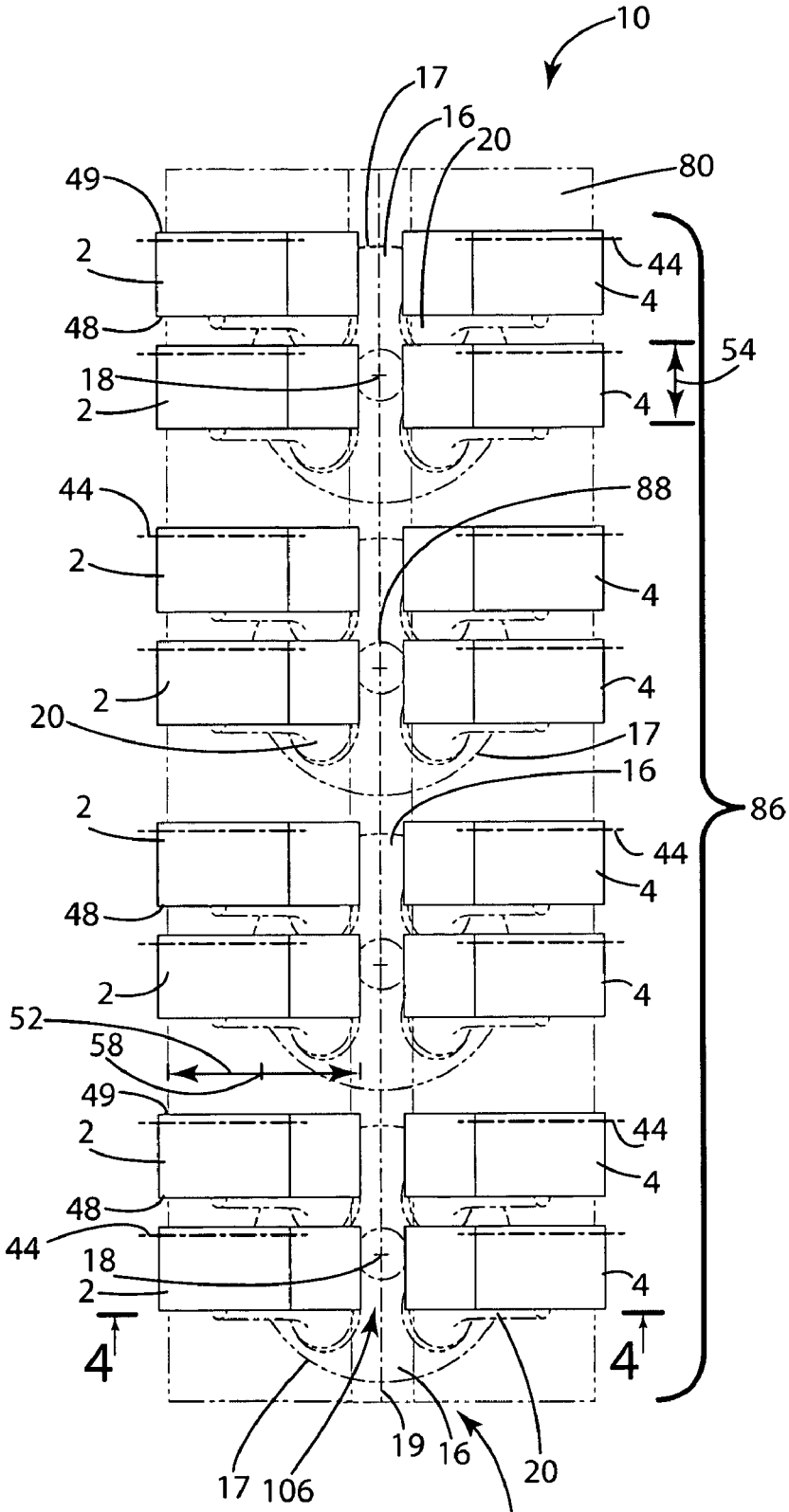
FIG. 3 is a top plan view of a lever electromechanical valve actuator assembly on a cylinder head.

A lever electromechanical valve actuator assembly shown generally at 10 in FIG. 3 is mounted on a cylinder head 80 of an internal combustion engine 12 and with individual actuators 2, 4 being at least partially located over an associated cylinder 16. The actuators 2, 4 operably associated with a particular cylinder 16 may be referred to as actuator groups 11. Each actuator 2, 4 of the lever electromechanical valve actuator assembly 10 is connected to a valve 20, such as an intake or exhaust valve, to open and close the valve 20 as desired. The electromechanical valve actuator assembly 10, as illustrated in FIG. 3, and as illustrated in the alternative embodiments shown in FIGS. 5–15, provides a more compact arrangement while allowing greater serviceability and easier assembly.

Figure 14:
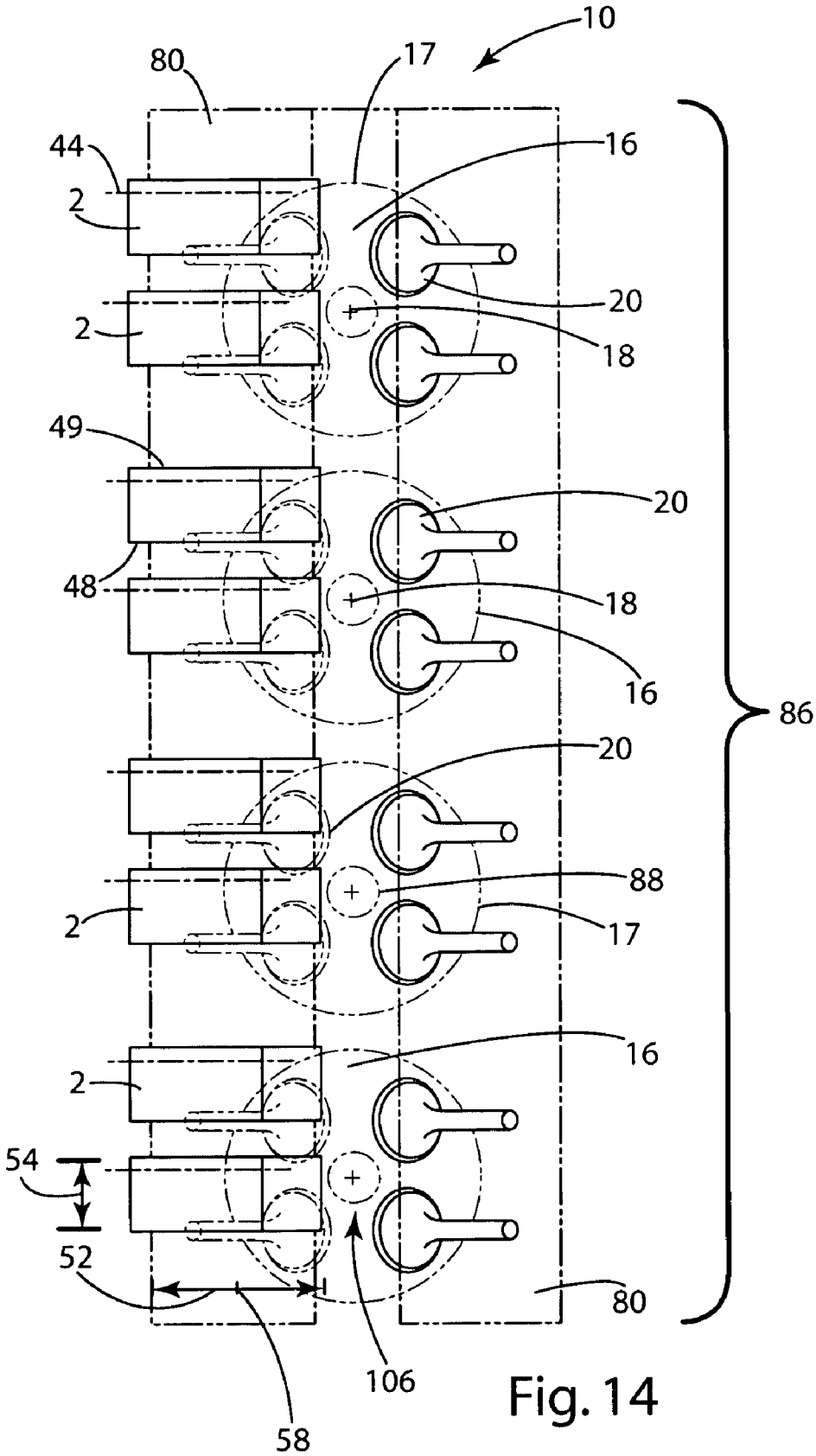
FIG. 14 is a top plan view of the lever electromechanical valve actuator assembly on a cylinder head with only intake actuators.
Figure 15:
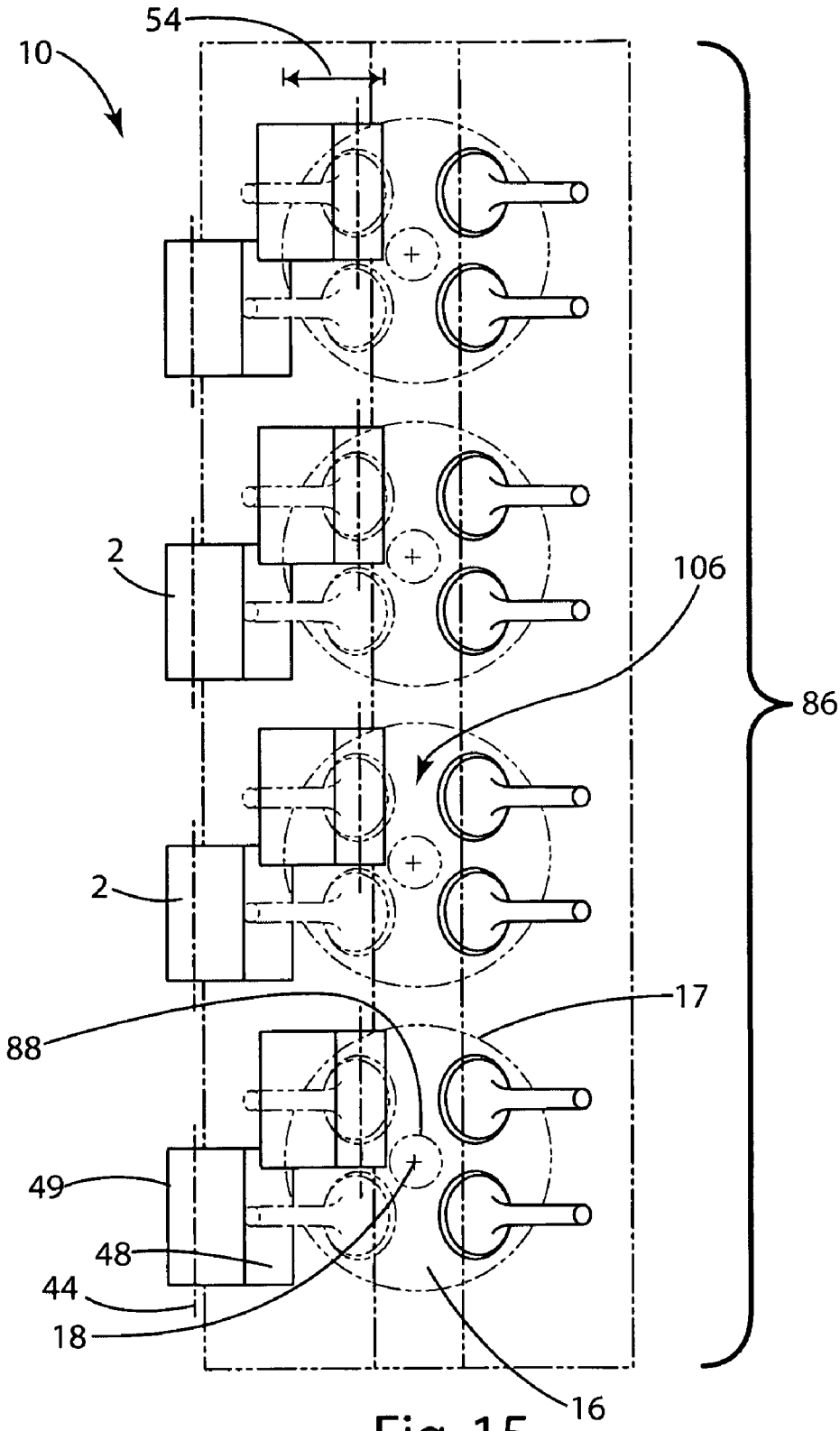
FIG. 15 is a top plan view of the second alternative electromechanical valve actuator assembly on a cylinder head with only intake actuators.

The electromechanical valve actuator assembly 10 generally includes both intake actuators 2 and exhaust actuators 4 as illustrated in FIGS. 3 and 4–13. Of course, the actuator assembly 10 may include only intake actuators 2 as illustrated in FIGS. 14 and 15, only exhaust actuators (not shown), or a combination of the illustrated and claimed embodiments varying by cylinder or by intake or exhaust sides. For example, one actuator assembly may be suited for the intake side while another actuator assembly may be better suited for the exhaust side, or different actuator assemblies may be used for different cylinders depending on engine configuration and packaging needs.

The actuators 2, 4 each include an armature assembly shown generally at 30 having an armature plate 32 and a connecting rod 90, an electromagnet assembly shown generally at 70 having electromagnets 72, 74, and a spring assembly shown generally at 60. The armature plate 32 is alternatively attracted to the electromagnets 72, 74, thereby applying force to the spring assembly 60 and valve 20 through the connecting rod 90 to open and close the valve 20. While the actuators 2, 4 are illustrated as having a connecting rod 90, the actuators may be formed without the use of a connecting rod. Further, any lever electromechanical valve actuator configuration, shape, or assembly may be substituted for the illustrated electromechanical valve actuators in the figures, as the present invention is primarily directed to the arrangement of the electromechanical valve actuators 2, 4 relative to each other, relative to the cylinder head 80, and relative to the cylinders 16.

Figure 4:
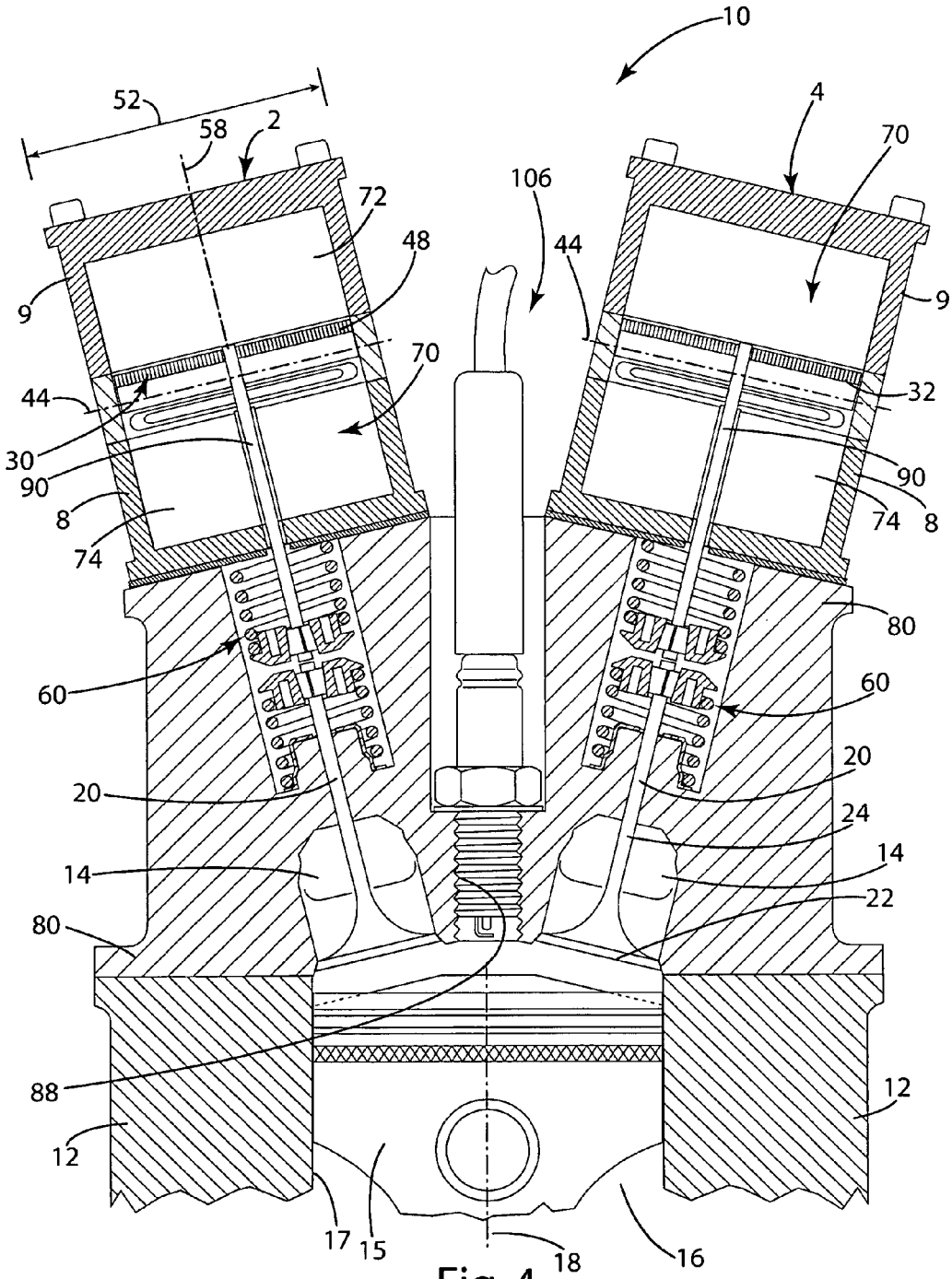
FIG. 4 is a cross-sectional view along lines 4—4 in FIG. 3.
Figure 8:
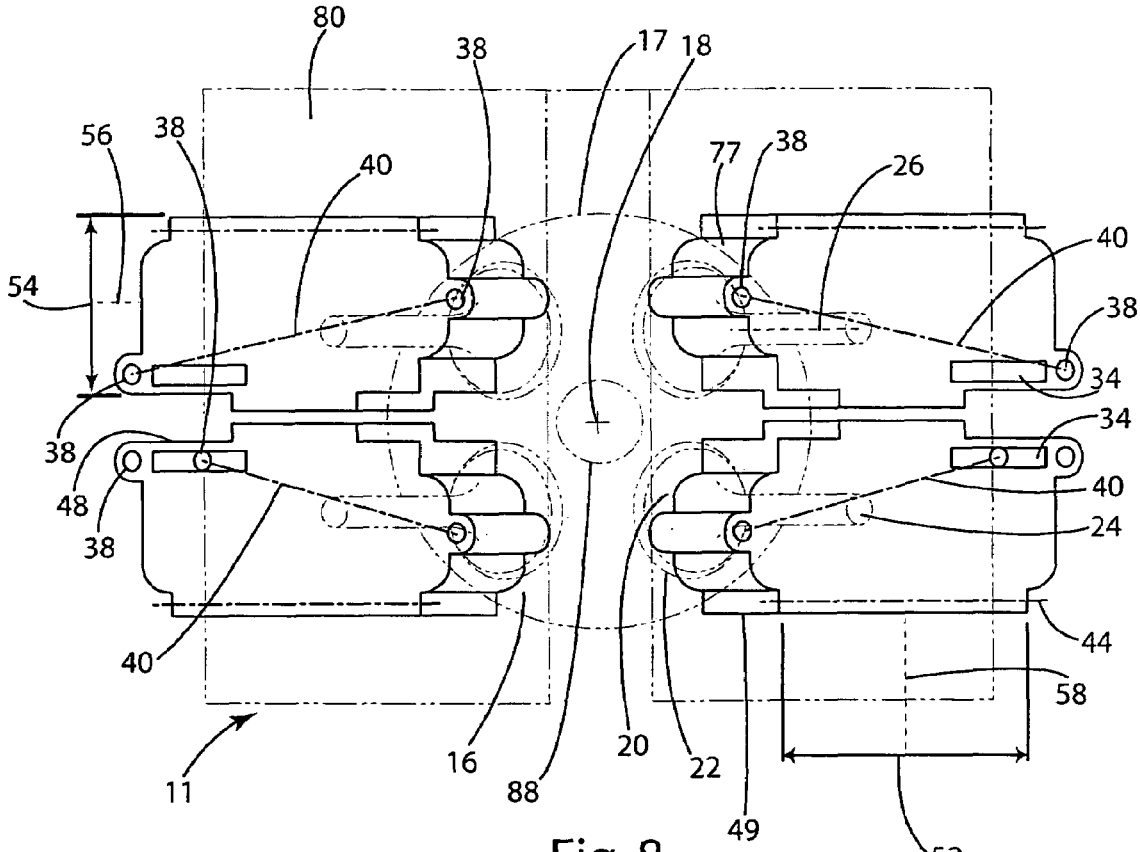
FIG. 8 is an enlarged top plan view of a portion of the actuator assembly in FIG. 7.

The valve 20 is similar to traditional valves and generally includes a valve head 22 with a valve stem 24 extending therefrom. The valve 20 has an opened and closed position and is illustrated in FIG. 4 in the closed position. In the closed position, the valve head 22 seals a valve port 14 to the corresponding cylinder 16. The valve port 14 may be an exhaust port or intake port and the actuator 2, 4 operably controlling the valve 20 associated with the exhaust valve port is the exhaust actuator 4 and the valve 20 associated with the intake port is controlled by the intake actuator 2. As shown in FIG. 8, the valve 20 generally moves along a valve axis 26 between the open and closed positions.

Figure 10:
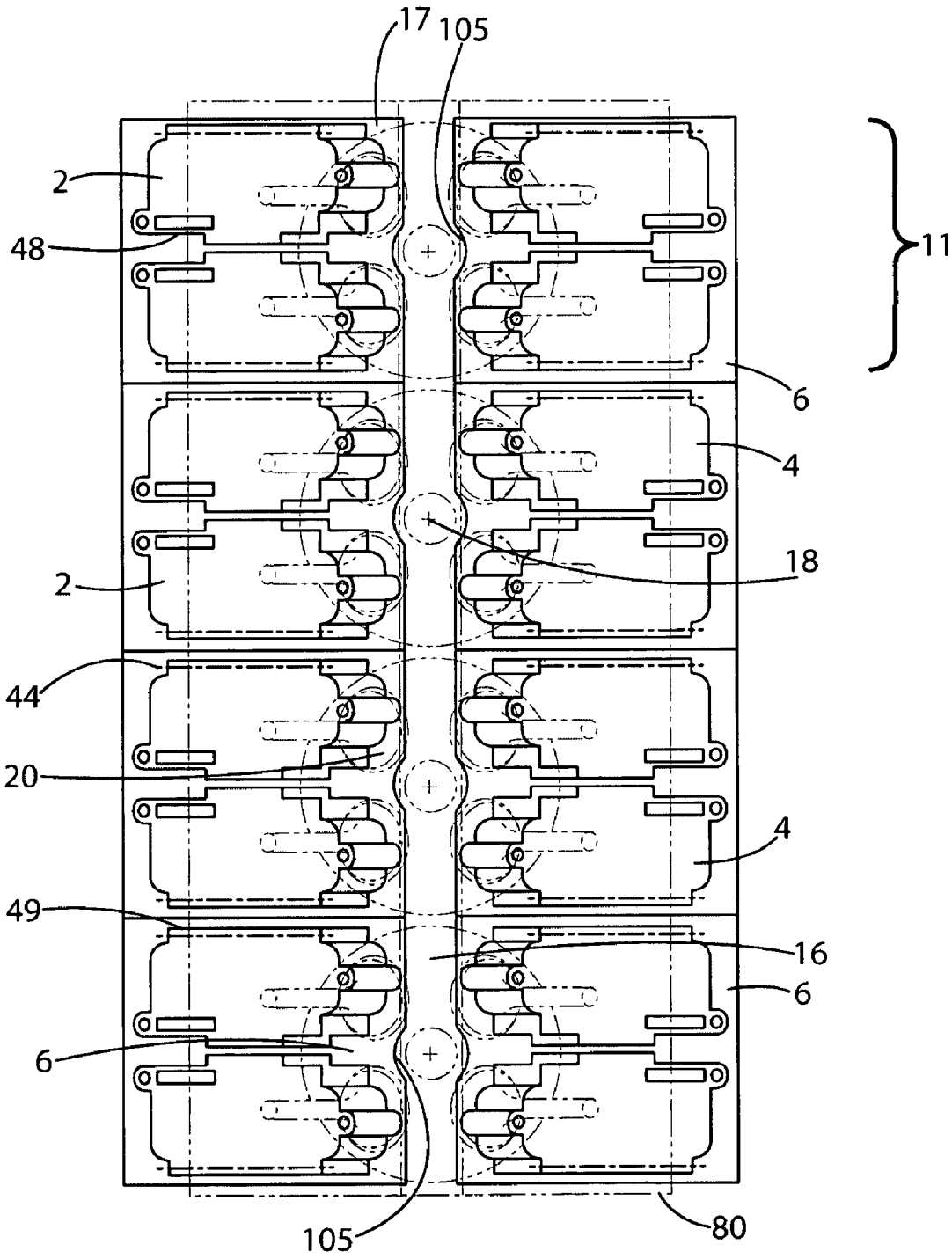
FIG. 10 is a top plan view of a fifth alternative lever electromechanical valve actuator assembly on a cylinder head wherein a pair of actuators are coupled together.

The electromagnet assembly 70 controls the movement of the armature assembly and thereby the movement of the valve 20. The electromagnets 72, 74 are generally secured to c-blocks 8, 9 which are in turn secured to the cylinder head 80. A housing plate 6 may operably couple a pair of actuators together for ease of assembly, as illustrated in FIG. 10. The housing plate 6, if used, may include a recess 105 to provide sufficient room for accessing the spark plug.

The armature assembly 30 includes the armature plate 32 and the connecting rod 90. The armature plate 32 pivots about a pivot axis 44 near a pivot end 49 of the armature plate 32 to open and close the valve 20. The connecting rod 90 is coupled to or driven by the armature plate 32. The armature plate 32 further includes a lever end 48 which is opposite the pivot end 49. While any electromechanical valve actuator may be used in the present invention to create the lever electromechanical valve actuator assembly 10, the electromechanical valve actuators 2, 4 described above and illustrated in FIG. 4 provide further space savings and further facilitate the arrangement of the electromechanical valve actuators. Further, by locating the actuator so that the valve 20 is inward of the lever end 48, additional space savings may be realized.

To facilitate the description of the electromechanical valve actuator assembly 10 and the specific arrangement of the actuators 2, 4 relative to each other, the geometry and directional arrangement such as longitudinal and lateral extents of the cylinder head 80, the cylinder 16, and the actuators 2, 4 must first be described. The internal combustion engine 12 includes a desired number of cylinders 16. The cylinders 16 may be arranged in any shape or configuration possible for the operation of an internal combustion, such as an in-line four cylinder engine or a V-6 engine. The cylinders 16 each include a cylinder axis 18 along which the piston 15 travels. Cylinders 16 also include a perimeter wall 17. In this application and in the claims, when the perimeter is referred to as being extended toward the actuators 2, 4 or the extended perimeter, that description generally refers to not the actual extent of the perimeter 17 defined by the cylinder walls but a theoretical or virtual extension of the perimeter of the cylinder walls, beyond where the cylinder wall perimeter 17 actually stops when it meets the cylinder head 80, toward the actuators 2, 4. The cylinders 16 may further be described as being arranged along a cylinder longitudinal extent 19, which is generally along a longitudinal extent of the engine or parallel to a longitudinal extent of the engine, specifically along a line drawn through the axes 18 of the cylinder 16. The cylinder head 80 also includes a longitudinal extent 86 that generally corresponds to the direction in which the cylinder longitudinal extent 19 extends and a cylinder head lateral extent 84, which is generally perpendicular to the cylinder longitudinal extent 19. The cylinder head 80 also defines spark plug holes 88, and is generally banked, as best illustrated in FIG. 4.

Figure 5:
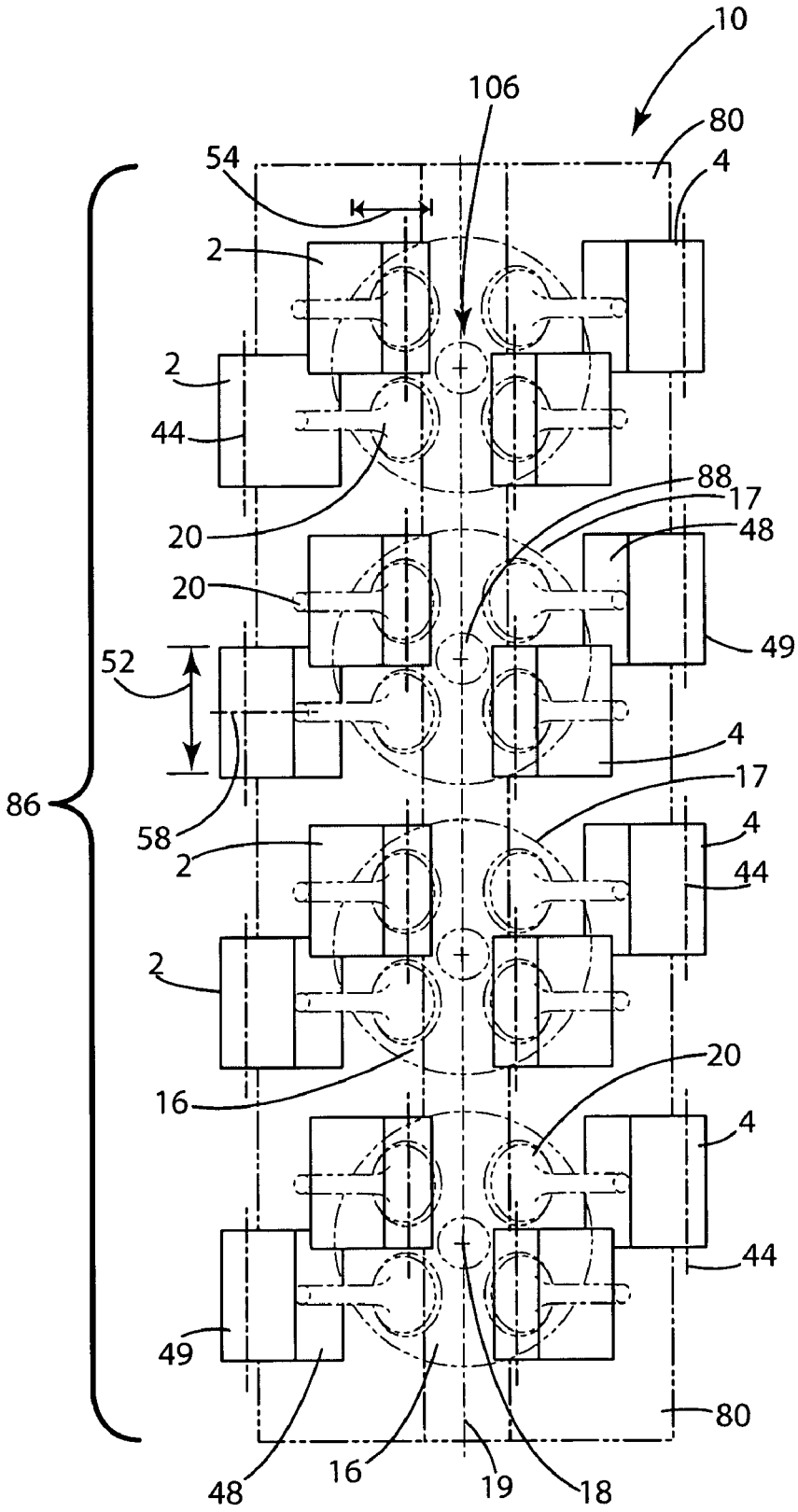
FIG. 5 is a top plan view of a first alternative lever electromechanical valve actuator assembly arrangement on a cylinder head.
Figure 6:
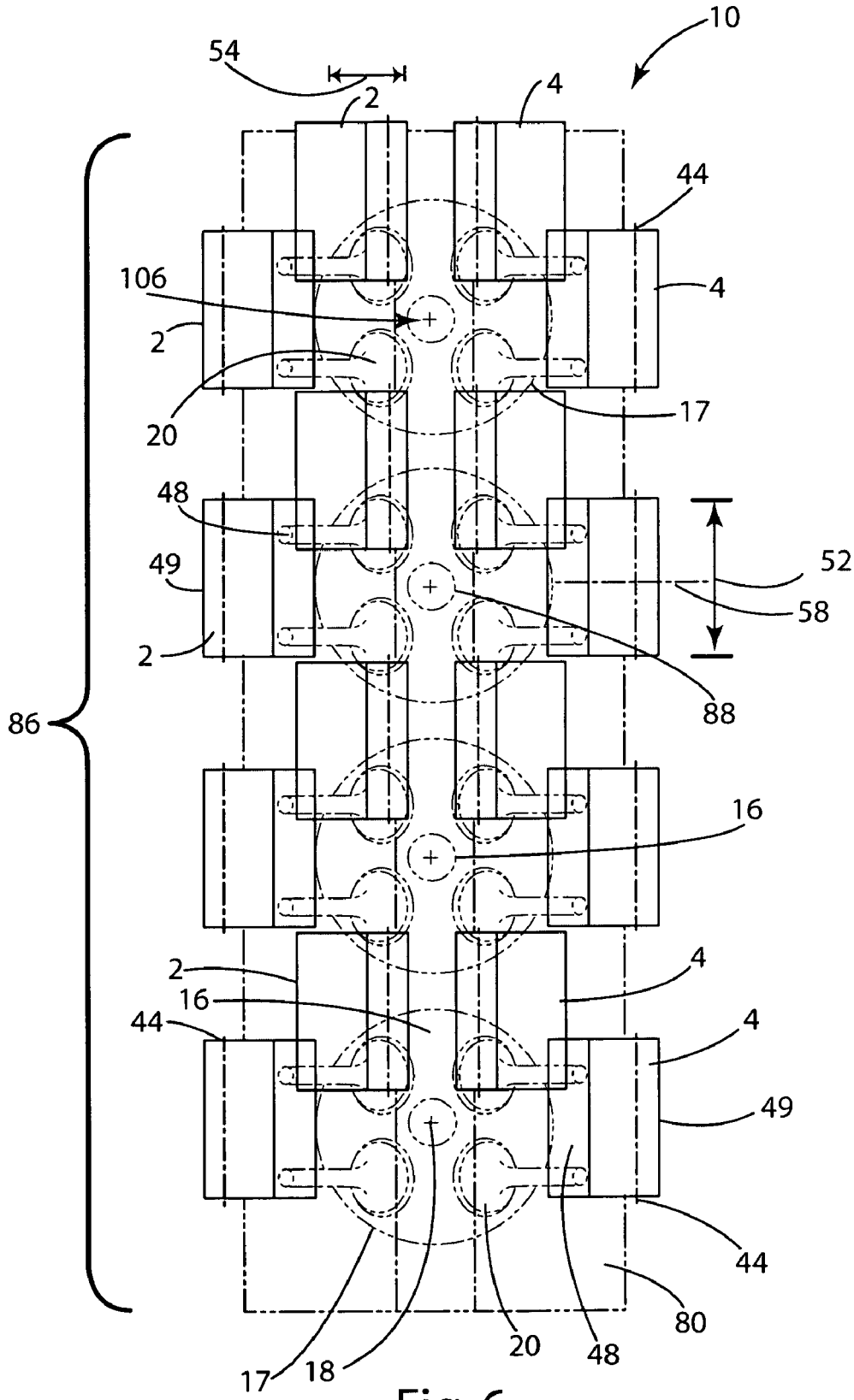
FIG. 6 is a top plan view of a second alternative lever electromechanical valve actuator assembly arrangement on a cylinder head.
Figure 7:
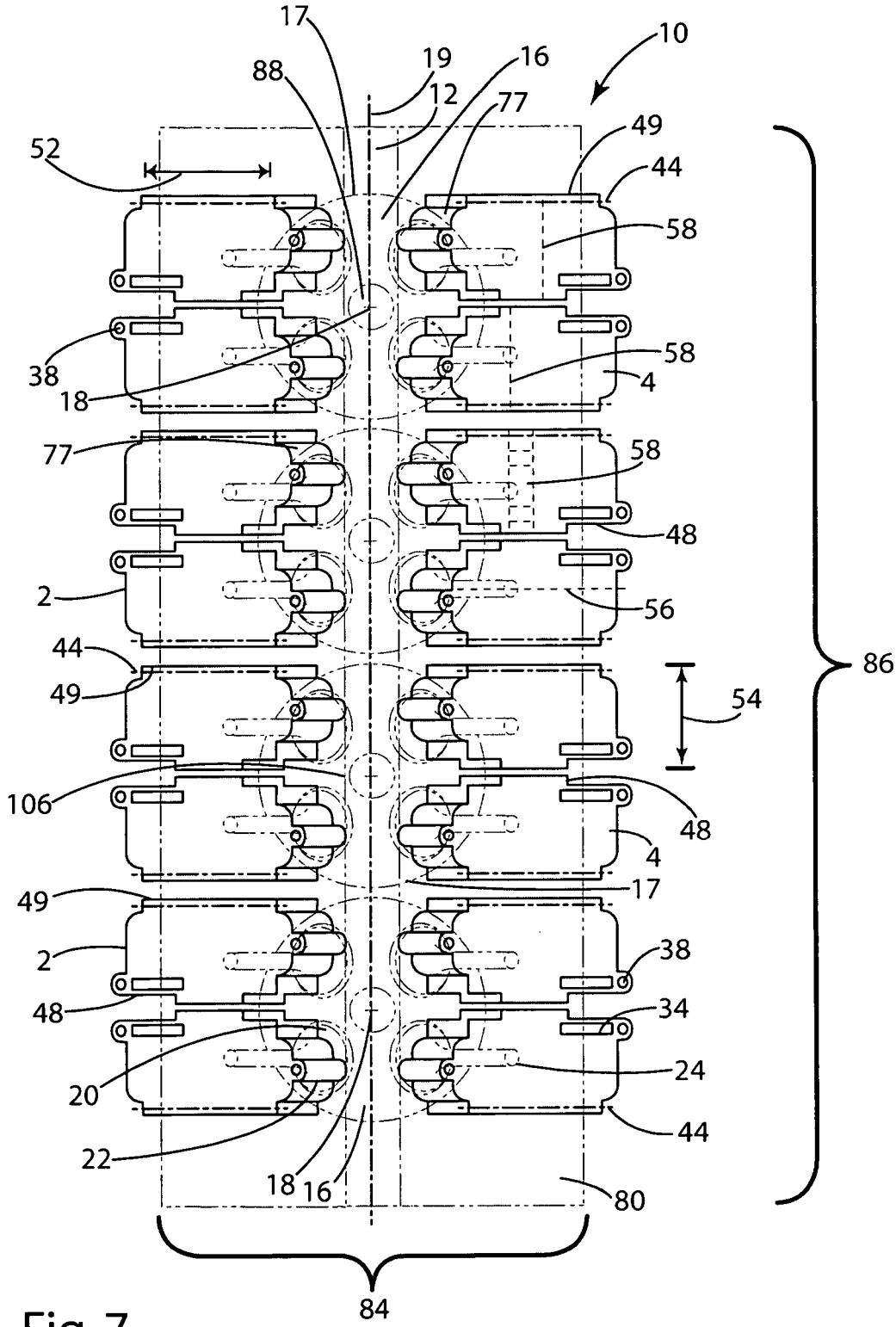
FIG. 7 is a top plan view of a third alternative lever electromechanical valve actuator assembly on a cylinder head.

The actuators 2, 4 generally include a longitudinal actuator extent 52 which is generally aligned with the pivot axis 44 and a lateral actuator extent 54 which is somewhat perpendicular to the pivot axis 44 (FIGS. 3 and 5–13). The actuators 2, 4 may also include a longitudinal actuator center 58, which is approximately the center of the longitudinal actuator extent 52, and a lateral actuator center 56 which is approximately the center of the lateral actuator extent 54. As illustrated in FIG. 7, due to the bank of the actuator, the longitudinal center may be viewed as an angled plane. The longitudinal actuator center 58 is illustrated as different between the top and bottom of the actuators, even though each of the lines is at the longitudinal center 58 due to the angle of view from which the figure is illustrated.

In the primary embodiment, illustrated in FIG. 3, the lever electromechanical valve actuator assembly 10 is arranged so that intake actuators 2 are arranged so that the pivot axes 44 are approximately perpendicular to the cylinder head longitudinal extent 86. More specifically, the longitudinal actuator extent 52 is arranged approximately perpendicular to the cylinder head longitudinal extent 86. Therefore, as illustrated in FIG. 3, the actuators 2, 4 are arranged on the cylinder head 80 in a lateral configuration, wherein the intake actuators 2 are approximately aligned along their longitudinal extent and laterally relative to the cylinder longitudinal extent 86. The exhaust actuators 4 are also approximately aligned along their longitudinal extent and laterally relative to the cylinder longitudinal extent 86. In this arrangement and as illustrated in FIG. 3, the pivot end 49 of one actuator is arranged in closer proximity to the lever end 48 of the adjacent actuator over the same cylinder 16, than the pivot end 49 of one actuator is in proximity to the pivot end 49 of the adjacent actuator. The arrangement of the pivot end 49 being in close proximity to the lever end 48 of the adjacent actuator arranges the actuators so that the actuators are oriented in the same direction and that the pivot end 49 of one actuator is closer to the lever end 48 of the adjacent actuator than the pivot end 49 of adjacent actuator. Further, as illustrated in FIG. 3, the intake actuators 2 all face the same direction and if included, as shown in FIG. 3, the exhaust actuators also face the same direction. Of course, the intake actuators 2 may all face the same direction while the exhaust actuators 4 all face the same direction, but opposite the direction of the intake actuators 2 (not shown). As further illustrated in FIG. 3, the pivot axes 44 of the intake actuators 2 are substantially parallel and the pivot axes 44 of the exhaust actuators 4 are also parallel, although not necessarily parallel to the intake actuators 2. As further illustrated in FIGS. 3 and 4, the pivot axes 44 of the intake actuators 2 and the exhaust actuators 4 are generally angled relative to each other due to the angled arrangement of the valves 20 and the banking of the cylinder head 80. Therefore, even though the intake actuators 2 may be aligned along the cylinder head longitudinal extent 86 with an exhaust actuators 4, such that the pivot axes 44 of an intake actuator 2 is aligned along the longitudinal extent 86 with a pivot axis 44 of an exhaust actuator 4, the pivot axes 44 are generally angled relative to each other.

As further illustrated in FIG. 3, the connecting rod 90 which is coupled to the valve 20 is connected to approximately the center of the longitudinal actuator extent 52, or along the longitudinal actuator center 58. However, the connecting rod 90 may be coupled to a position on the actuators 2, 4 which is offset from the longitudinal actuator center 58. This offset configuration may allow greater serviceability of the engine and easier access to the spark plug hole 88 defined by the cylinder head 80.

In the illustrated embodiment, the actuator assembly 10 is arranged over the cylinders 16. As shown in FIGS. 3 and 5–13, if the cylinder outer perimeter 17 is extended toward the actuators 2, 4, each of the lever electromechanical valve actuators 2, 4 is located at least partially outside the extended perimeter.

In the first alternative embodiment illustrated in FIG. 5, the actuator assembly 10 is also arranged such that the pivot axes 44 are parallel. More specifically, in the first alternative embodiment, the intake actuators over a particular cylinder 16 are arranged such that they are opposing the adjacent intake actuator. Therefore, the adjacent actuators over a particular cylinder 16 are arranged such that the lever ends 48 are closer together than the lever end 48 of a particular actuator is to its pivot end 49. As illustrated in FIG. 5, the intake actuators over a particular cylinder 16 are offset relative to each other. Further, the exhaust actuators 4 in the illustrated embodiment are offset approximately the same amount so that one pair of intake and exhaust actuators 2, 4 is laterally aligned along the cylinder longitudinal extent 86 while the other pair is also aligned along the cylinder longitudinal extent 86. More specifically, each of the intake and exhaust actuators 2, 4 are offset relative to the adjacent actuator 2, 4 on the same cylinder 16 along their longitudinal actuator extent. Although the valve 20 and connecting rod 90 are illustrated as being approximately centered along the longitudinal actuator extent 52, the valve coupled to the actuators 2, 4 may be offset from the longitudinal actuator center 58. Further, in this embodiment each one of the actuators 2, 4 is at least partially located outside the extended outer perimeter wall 17 of the cylinder 16. With the perimeter 17 extended toward the actuators 2, 4, the area within the extended perimeter 17 is less than half filled by the actuators 2, 4, providing substantial room on the cylinder head 80 between the actuators 2, 4 for serviceability.

The second alternative embodiment illustrated in FIG. 6 further provides serviceability by increasing the area around the spark plug hole 88 on the cylinder head 80 to create a spark plug access area 106. The arrangement illustrated in FIG. 6 is similar to the arrangement in FIG. 5, except that the actuators 2, 4 are shifted in one direction along the cylinder head longitudinal extent 86, with the valve 20 coupled to actuators 2, 4 shifted to one side.

The third alternative embodiment as illustrated in FIGS. 7 and 8, the valve 20 may be located approximately near the center of the actuator and therefore near the center of the armature plate 32 and therefore approximately near the longitudinal actuator center 58 and lateral actuator center 56. The third alternative embodiment is very similar to the embodiments shown in FIGS. 5 and 6, with the actuators 2, 4 being adjacent to each other and with each actuator being at least partially disposed outside the extended perimeter 17. Similar to the second embodiment, the actuator assembly 10 in the third alternative embodiment is arranged such that the pivot axes 44 are parallel. However, as compared to the second alternative embodiment the pivot axes 44 as illustrated in FIGS. 7 and 8 are arranged such that they extend laterally across the cylinder head 80. Therefore, the pivot axes 44 are arranged similar to the assembly in FIG. 3, except that the actuators individually are arranged such that the lever ends 48 are closer together than the lever end 48 of a particular actuator 2, 4 is to its pivot end 49 or to the pivot end of the adjacent actuator. The relative closeness of two adjacent pivot ends 49 or two adjacent lever ends 48 may vary as needed. The actuators 2, 4 are illustrated as being independently arranged on the cylinder head 80 although, as illustrated in the fifth alternative embodiment in FIG. 10, the actuators may be attached to a common housing plate 6 to be coupled as a unit to the cylinder head 80 for ease of assembly. In place of a common housing plate 6, a common housing holding the actuators as a unit such as an extended c-block (not shown) may also be used to couple the actuators of a particular cylinder together.

As further illustrated in FIG. 8, the valve stem 24 extending from the valve may be arranged relative to a line 40 extended between the bolt centers of the bolt holes 38 of the actuators. The line 40 may cross the axis or perimeter of the valve stem extended toward the line 40. Aligning the line 40 between the bolts approximately over the valve stem distributes clamping loads along a line that contains the load associated with the valve stem and connecting rod 90. Although not required, it may be beneficial to make the axis of the valve stem 24 approximately perpendicular to the line 40. As illustrated in FIG. 8, the actuators may further include a bolt slot 34 allowing ease of assembly on various engines with different bolt patterns.

Figure 9:
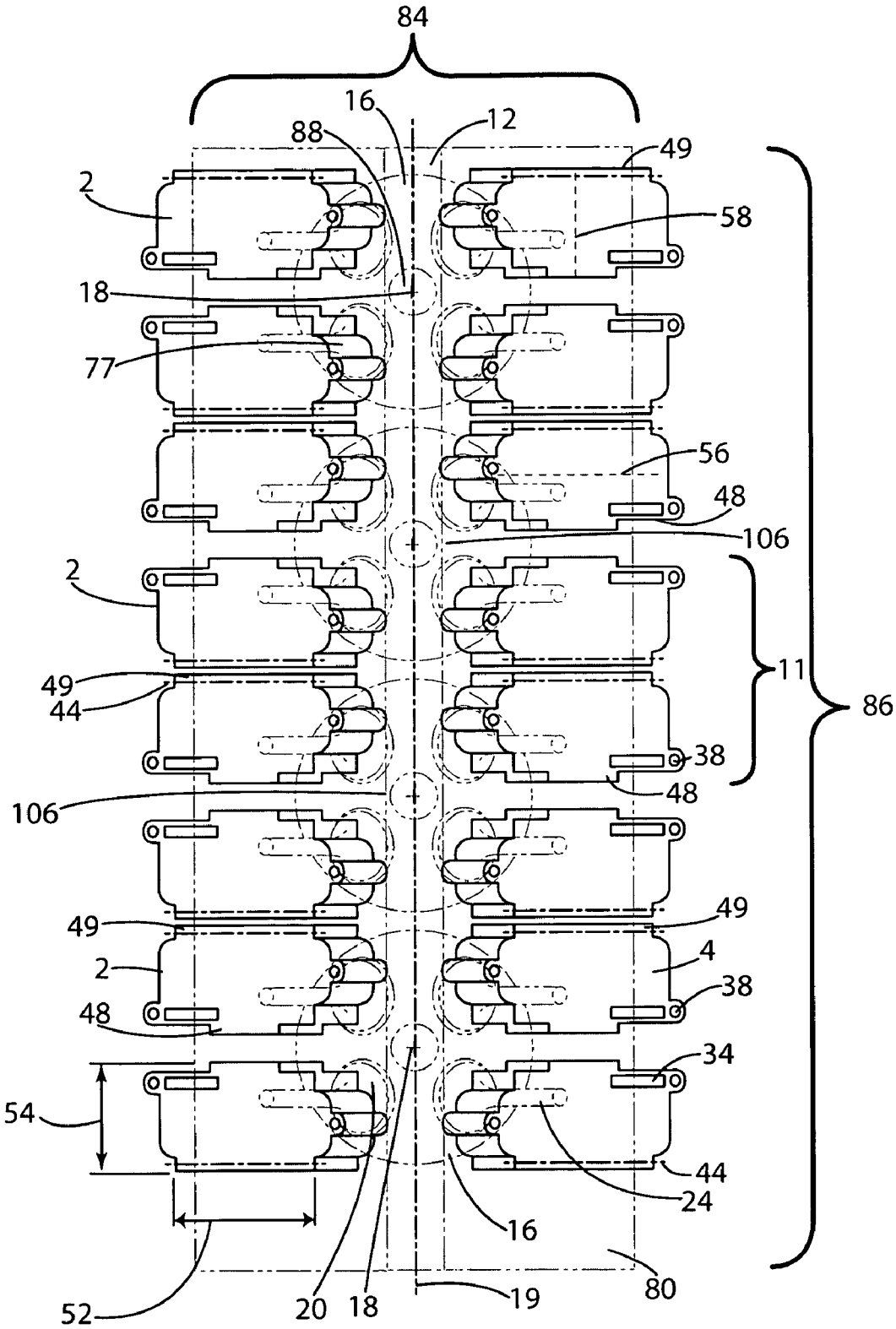
FIG. 9 is a top plan view of a fourth alternative lever electromechanical valve actuator assembly on a cylinder head.
Figure 11:
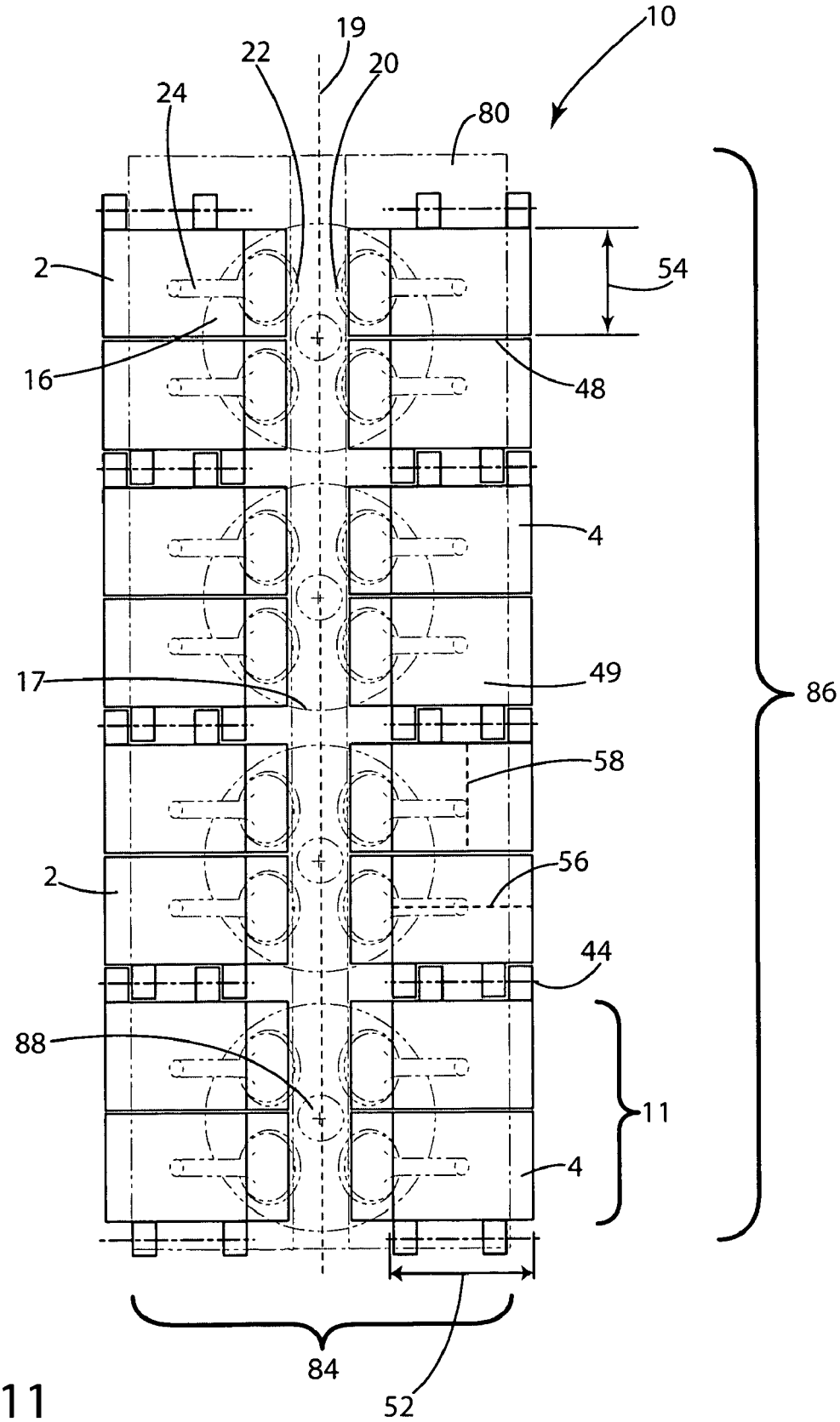
FIG. 11 is a top plan view of a sixth alternative lever electromechanical valve actuator assembly on a cylinder head.

In the fourth alternative embodiment, as illustrated in FIG. 9, the actuators may be shifted so that actuators on adjacent cylinders are in closer proximity than the actuators operationally over a particular cylinder. This shift as compared to the third alternative embodiment illustrated in FIGS. 7 and 8 allows more room above the spark plug hole 88, thereby providing a larger spark plug access area 106. Although not illustrated, in some embodiments the actuators over adjacent cylinders may be coupled in a common housing for ease of assembly. The sixth alternative embodiment illustrated in FIG. 11 is also similar to the fourth alternative embodiment illustrated in FIG. 9, except that in the sixth alternative embodiment, the adjacent actuators over adjacent cylinders share a pivot axis 44 so that the armature plate 32 of adjacent actuators each being associated within a different cylinder pivot about the same axis. Although not illustrated, it should be relatively apparent to one skilled in the art based upon the illustration in FIG. 11 that the adjacent actuators may share the same hinge pin. Therefore, as illustrated in FIG. 11, the pivot ends of adjacent actuators over adjacent cylinders are not only closer in proximity than the lever ends of adjacent actuators over the same cylinder, but the pivot ends overlap and extend within the adjacent armature plate 32. This overlapping of the pivot ends 49 allows the actuators to be associated in closer proximity, thereby allowing the actuator assembly 10 to be placed on a more compact cylinder head 80.

Figure 12:
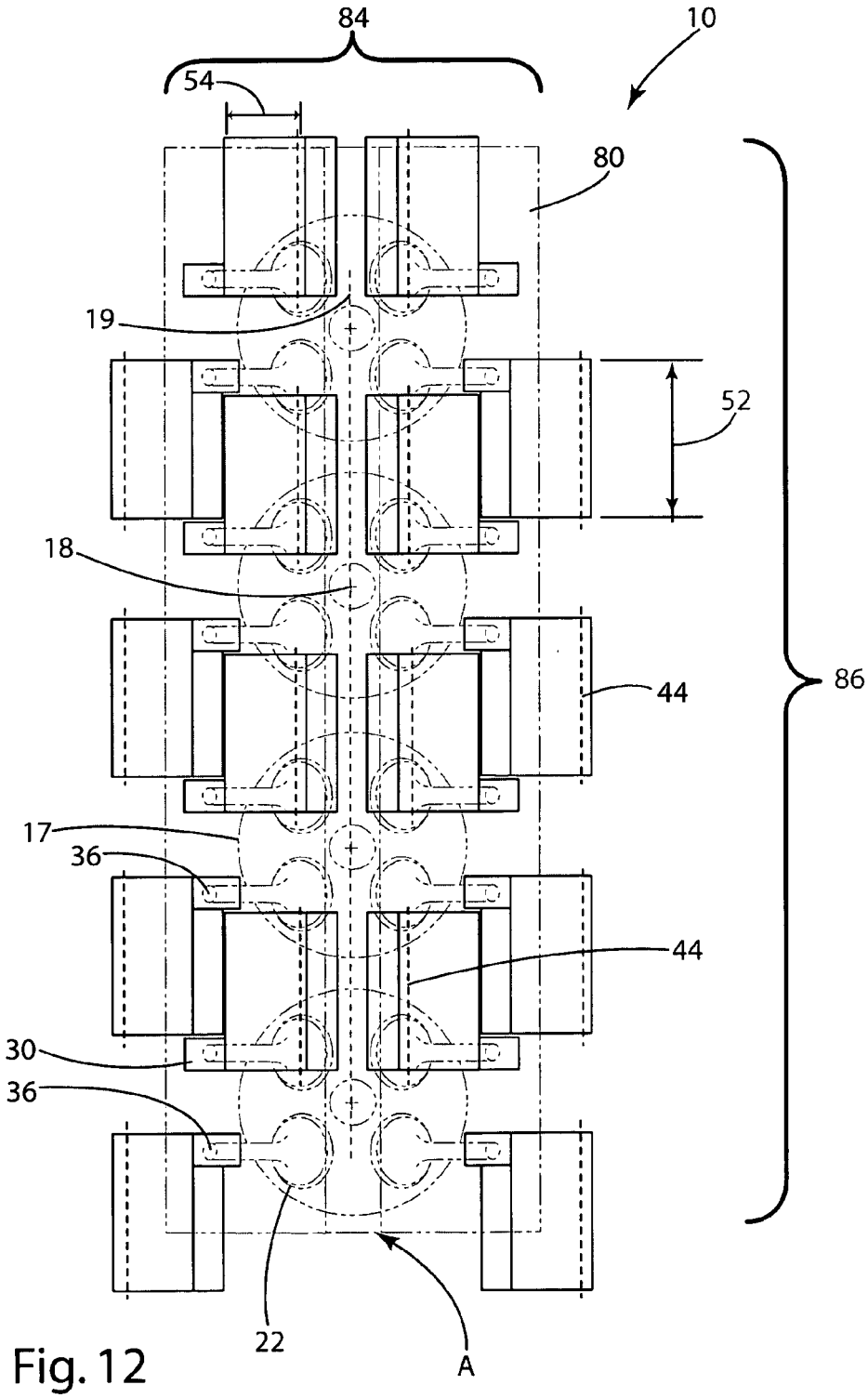
FIG. 12 is a top plan view of a seventh alternative lever electromechanical valve actuator assembly on a cylinder head.

The seventh alternative embodiment illustrated in FIG. 12 is similar to the third alternative embodiment illustrated in FIG. 6. As illustrated in FIG. 12, the actuators 2, 4, as well as the armature plate 32, include a protrusion 36 which is coupled to the valve 20. By coupling the valve 20 to the protrusion 36, various arrangements may be used, allowing a more compact actuator assembly 10. As shown in FIG. 12, by shifting the actuators along the longitudinal actuator extent 52 relative to each other and along the longitudinal cylinder head extent 86, the actuators may be brought in closer proximity to each other. However, the actuators in close proximity to each are generally actuators operationally associated with adjacent cylinders 16. Even though not illustrated, the actuators may be longitudinally aligned. The embodiment illustrated in FIG. 12 also provides a wide area A to receive a control module (not illustrated).

Figure 13:
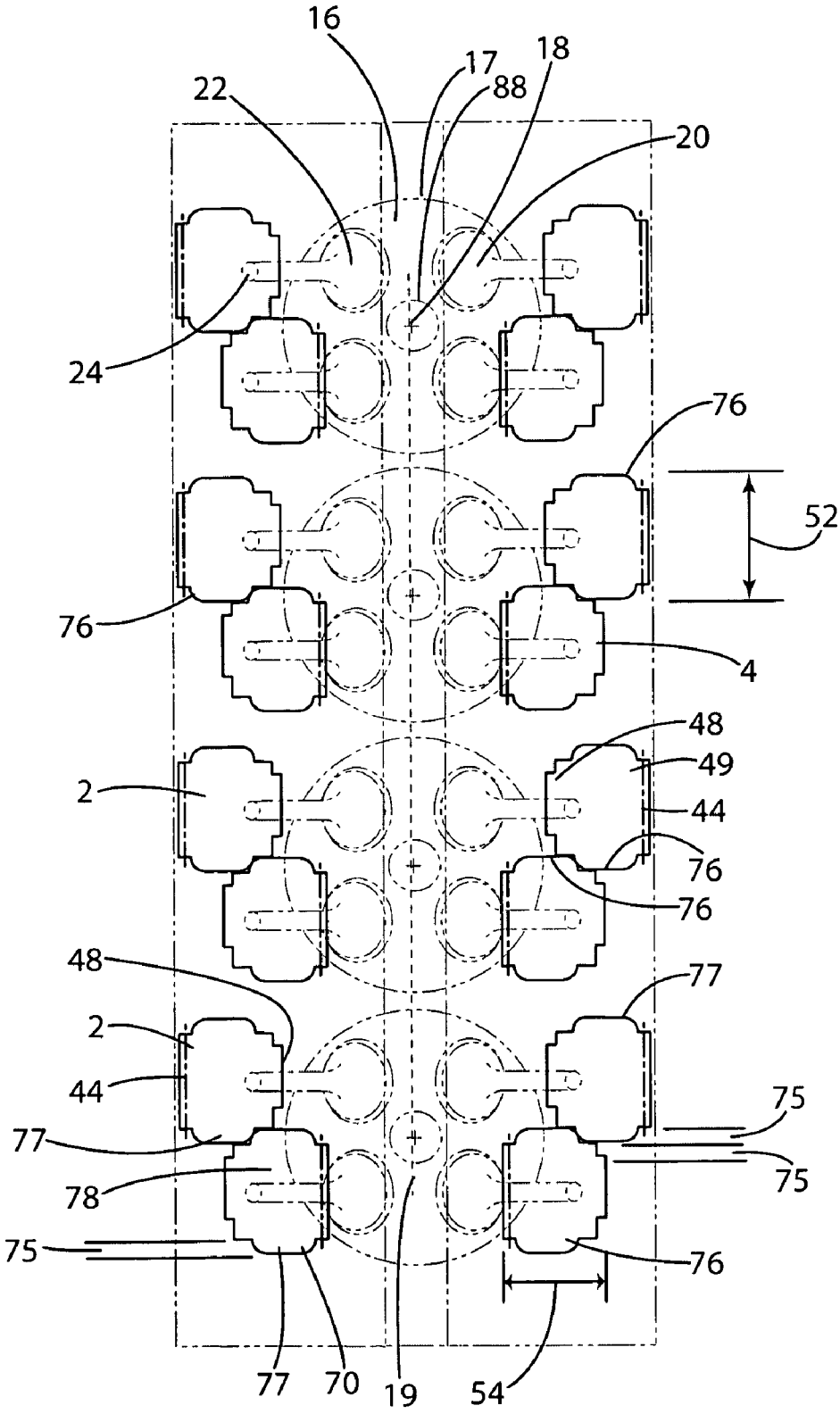
FIG. 13 is a top plan view of an eighth alternative lever electromechanical valve actuator assembly on a cylinder head.

An eighth alternative embodiment is illustrated in FIG. 13. In FIG. 13, the actuators are arranged such that the end turn 77 of a power coil 76 exiting a core 78 is disposed in close proximity to the adjacent actuator's core 78. The power coils 76 exit the core 78 on one end and turn back into the core 78 on the same end to create an end turn 77. The end turn 77 of the power coil 76 requires a minimum distance 75 from the end of the core 78 of the actuator in order to make a loop back into the core 78. Typically, the actuators, specifically the cores 78, must be spaced at least two times the minimum distance required by the coil 76 to make the end turn 77 to provide sufficient spacing. Therefore, the actuators are arranged in an offset manner both laterally and longitudinally along a cylinder head 80 such that the actuators are spaced apart less than the two times the distance required for end turn 77. In the embodiment illustrated in FIG. 13, careful placement of the actuators on the cylinder head 80 and relative to the cylinder 16 allows the actuators to be placed in closer proximity between two adjacent cores 78 than two times the distance 75 required for the end turn 77 of the power coil 76. As illustrated in FIG. 13, the actuators may be placed within approximately the distance 75 required for one end turn 77 of the coil 76 from the core. Therefore, the cores 78 are in close proximity, allowing better placement of the valves relative to the actuators as well as providing plenty of spark plug access area 106.

The remaining actuator assemblies in FIGS. 14 and 15 illustrate how the actuators may just be used for the intake side of a cylinder head or the exhaust side.

The foregoing discussion discloses and describes an exemplary embodiment of the present invention. One skilled in the art will readily recognize from such discussion, and from the accompanying drawings and claims that various changes, modifications and variations can be made therein without departing from the true spirit and fair scope of the invention as defined by the following claims.

What is claimed is:

1. A lever electromechanical valve actuator assembly for a vehicle engine having cylinders and a cylinder head with a longitudinal cylinder extent, the cylinder head being disposed between the lever electromechanical valve actuator assembly and the cylinders, said electromechanical valve actuator assembly comprising:

a first actuator having a first pivot axis;

a second actuator having a second pivot axis, said first and second pivot axes each being approximately within forty five degrees of perpendicular to the longitudinal cylinder extent.

2. The lever electromechanical valve actuator assembly of claim 1 wherein said pivot axes are approximately perpendicular to the longitudinal cylinder extent.

3. The lever electromechanical valve actuator assembly of claim 1 wherein each of said first and second actuators include a longitudinal actuator extent and wherein said cylinder head includes a lateral cylinder head extent, said first and second actuators being approximately aligned along their longitudinal actuator extents with said lateral cylinder head extent.

4. The lever electromechanical valve actuator assembly of claim 1 wherein said first and second actuators each further include a pivot end and a lever end and wherein said first and second actuators are arranged so that said each of said lever ends are in closer proximity than said lever ends are to said pivot ends and said lever ends are in closer proximity than said pivot ends are to each other.

5. The lever electromechanical valve actuator assembly of claim 1 wherein said first and second actuators are each intake actuators associated with a cylinder, said first and second actuators being coupled together in a housing.

6. The lever electromechanical valve actuator assembly of claim 1 wherein said first and second actuators are each intake actuators and wherein said first actuator is associated with a first cylinder and wherein said second actuator is associated with an adjacent cylinder, said actuators being coupled together in a housing.

7. The lever electromechanical valve actuator assembly of claim 6 further including a hinge pin and wherein said first and second actuators are each coupled to said hinge pin.

8. The lever electromechanical valve actuator assembly of claim 1 further including a valve coupled to said first actuator, said valve including a valve head having a diameter, said diameter being extended toward said actuator and wherein said first actuator includes a first bolt and a second bolt for securing said first actuator to the cylinder head and wherein a line may be extended between the centers of said first and second bolts, said line being located at least partially within said extended diameter of said valve head.

9. The lever electromechanical valve actuator assembly of claim 8 wherein said valve is movable between an open position and a closed position along a valve axis and said line approximately intersects said valve axis.

10. The lever electromechanical valve actuator assembly of claim 1 further including a housing defining a first bolt hole and a bolt slot.

11. A lever electromechanical valve actuator assembly for a vehicle engine having cylinders and a cylinder head defining spark plug holes and having a longitudinal cylinder head extent, the cylinder head being disposed between the lever electromechanical valve actuator assembly and the cylinders, said electromechanical valve actuator assembly comprising a first actuator having a first pivot axis approximately aligned between two adjacent spark plug holes and approximately aligned with the longitudinal cylinder head extent.

12. The lever electromechanical valve actuator assembly of claim 11 wherein said spark plug holes are aligned along a cylinder longitudinal extent and wherein said first pivot axis is displaced laterally from the cylinder longitudinal extent.

13. The lever electromechanical valve actuator assembly of claim 11 further including a second actuator having a second pivot axis approximately aligned between two adjacent spark plug holes and approximately aligned with said first pivot axis.

14. The lever electromechanical valve actuator assembly of claim 13 wherein said spark plug holes are aligned along cylinder longitudinal extent and wherein said first pivot axis and said second pivot axis are displaced laterally from said cylinder longitudinal extent.

15. The lever electromechanical valve actuator assembly of claim 13 wherein said first actuator is operationally associated with a first cylinder and said second actuator is operationally associated with a second cylinder adjacent to said first cylinder.

16. The lever electromechanical valve actuator of claim 15 further including third actuator operationally associated with said first cylinder, said third actuator being offset along the cylinder head longitudinal extent from said first actuator.

17. The lever electromechanical valve actuator assembly of claim 14 wherein said third actuator includes a third pivot axis, offset laterally from said first and second pivot axes, and wherein said third pivot axis is approximately aligned with said second actuator along the cylinder head longitudinal extent.

18. The lever electromechanical valve actuator assembly of claim 17 wherein said pivot axes are approximately parallel.

19. The lever electromechanical valve actuator assembly of claim 11 further including a second actuator having a second pivot axis approximately aligned with said first pivot axis.

20. The lever electromechanical valve actuator assembly of claim 11 wherein said first actuator includes a first armature plate having a first protrusion.

21. The lever electromechanical valve actuator assembly of claim 20 further including a valve coupled to said protrusion.

22. A lever electromechanical valve actuator assembly for a vehicle engine having cylinders and a cylinder head defining spark plug holes and having a longitudinal cylinder head extent, the cylinder head being disposed between the lever electromechanical valve actuator assembly and the cylinders, said electromechanical valve actuator assembly comprising:

a first actuator having a first pivot axis approximately aligned between two adjacent spark plug holes and approximately aligned with the longitudinal cylinder head extent and wherein said first actuator includes a first armature plate having a first protrusion; and a second actuator having a second armature plate with a second protrusion and wherein said first and second actuators include a longitudinal actuator extent, said first and second actuators being offset along their longitudinal actuator extents relative to each other.

23. The lever electromechanical valve actuator assembly of claim 22 wherein said actuators each include a lever end, and wherein each of said protrusions extend a protrusion distance from said respective lever end, and wherein said lever end of said first actuator is spaced less than said protrusion distance from said lever end of said second actuator.

24. A lever electromechanical valve actuator assembly for a vehicle engine having cylinders and a cylinder head with a longitudinal cylinder head extent, the cylinder head being disposed between the cylinders and the electromechanical valve actuator assembly, said electromechanical valve actuator assembly comprising:

a first actuator having a first core and a first power coil;

a second actuator having a second core and a second power coil and wherein each of said power coils form an end turn on at least one end of each of said first and second cores, said end turns extending a distance beyond said at least one end of each of said first and said second cores and wherein said first core and said second core are arranged so that said first core and said second core are displaced less than two times said distance apart.

* * * * *

UNITED STATES PATENT AND TRADEMARK OFFICE

CERTIFICATE OF CORRECTION

PATENT NO. : 7,152,558 B2 
APPLICATION NO. : 11/029305
DATED : December 26, 2006
INVENTOR(S) : Ha T. Chung et al.

It is certified that error appears in the above-identified patent and that said Letters Patent is hereby corrected as shown below:

On the Title Page, Item (56) References Cited, U.S. Patent Documents, "6,467,441 B1" should be --6,467,441 B2--.

On the Title Page, Item (56) References Cited, U.S. Patent Documents, "6,526,928 B1" should be --6,526,928 B2--.

On the Title Page, Item (56) References Cited, U.S. Patent Documents, "6,546,904 B1" should be --6,546,904 B2--.

On the Title Page, Item (56) References Cited, U.S. Patent Documents, "6,637,385 B1" should be --6,637,385 B2--.

On the Title Page, Item (56) References Cited, Other Publications please insert the following --DaimlerChrysler - Special Publication On The 24th International Vienna Motor Symposium, May 15-16, 2003, 37 pages--.

Signed and Sealed this

Seventh Day of August, 2007

JON W. DUDAS
*Director of the United States Patent and Trademark Office*